US006991518B1

(12) United States Patent
Gleason et al.

(10) Patent No.: US 6,991,518 B1
(45) Date of Patent: Jan. 31, 2006

(54) AUTOMATED SYSTEM FOR PRECISION GRINDING OF FEEDSTOCK

(75) Inventors: Robert C. Gleason, Butler, NJ (US); John Bannayan, New York, NY (US); Frederick A. Schumacher, Wyckoff, NJ (US)

(73) Assignee: Glebar Co., Inc., Franklin Lakes, NJ (US)

( * ) Notice: Subject to any disclaimer, the term of this patent is extended or adjusted under 35 U.S.C. 154(b) by 0 days.

(21) Appl. No.: 10/411,300

(22) Filed: Apr. 11, 2003

Related U.S. Application Data

(62) Division of application No. 10/164,089, filed on Jun. 6, 2002.

(51) Int. Cl.
*B24B 49/00* (2006.01)

(52) U.S. Cl. ..... 451/11; 451/49; 451/182; 451/407; 451/909

(58) Field of Classification Search ..... 451/11, 451/241, 242, 397, 914, 49, 178, 179, 182, 451/21, 12, 245, 909, 407, 5, 907
See application file for complete search history.

(56) References Cited

U.S. PATENT DOCUMENTS 642,452 A * 1/1900 Hull ..... 451/242
1,393,046 A * 10/1921 Singer ..... 451/407
1,844,805 A * 2/1932 Sims ..... 451/407
2,440,402 A * 4/1948 Horberg ..... 451/49
3,854,252 A * 12/1974 Lindsay et al. ..... 451/408
4,086,065 A * 4/1978 Maxey ..... 29/446
5,022,194 A 6/1991 Schumacher
5,213,348 A * 5/1993 Crossman et al. ..... 451/407
5,480,342 A * 1/1996 Bannayan et al. ..... 451/11
5,533,931 A * 7/1996 Imai et al. ..... 451/11
5,674,106 A 10/1997 Cheetham
5,746,644 A 5/1998 Cheetham
6,144,892 A 11/2000 Cheetham et al.
6,148,248 A * 11/2000 Sun et al. ..... 700/164
6,227,938 B1 5/2001 Cheetham et al.
6,312,314 B2 11/2001 Cheetham et al.

* cited by examiner

*Primary Examiner*—Hadi Shakeri
(74) *Attorney, Agent, or Firm*—Fitzpatrick, Cella, Harper & Scinto

(57) ABSTRACT

A grinding system for grinding feedstock includes a transport apparatus, a grinding apparatus, and a controller. The transport apparatus continuously transports feedstock of an arbitrarily long length at a desired feed rate, and the grinding apparatus grinds the feedstock transported by the transport apparatus. The controller controls a grinding position of the grinding apparatus and a longitudinal position of the feedstock during grinding to be coordinated with each other.

2 Claims, 10 Drawing Sheets

AUTOMATED SYSTEM FOR PRECISION GRINDING OF FEEDSTOCK

This application is a division of application Ser. No. 10/164,089, filed on Jun. 6, 2002, the entire disclosure of which is incorporated herein by reference.

BACKGROUND OF THE INVENTION

1. Field of the Invention

The present invention relates generally to a system for grinding feedstock, which may be of infinite length, to precise dimensions of circular cross section. More particularly, the system automatically produces a ground product with a precise cross-sectional diameter that may be fixed, that gradually changes along the length of the feedstock, and/or that abruptly changes in a step-like manner along the length of the feedstock.

2. Related Art

Conventional grinders for removing the outer surface of feedstock to produce a ground article of circular cross section include a centered or "OD" (outside diameter) grinder and a centerless grinder.

A sectional view of a conventional OD grinder 2 is schematically shown in FIG. 1. Typically, a piece of feedstock 4 is held by collets 6*a*, 6*b* of the grinder 2. The collets 6*a*, 6*b* are connected to a motor system (not shown), which provides a rotational driving force to rotate the collets 6*a*, 6*b* and the piece of feedstock 4 about a longitudinal axis l, as depicted by the curved arrows in FIG. 1. In general, the rotational axis of the collets 6*a*, 6*b* and the longitudinal axis l are coincident. The motor system also provides a translational driving force to move the collets 6*a*, 6*b* and the piece of feedstock 4 along the longitudinal axis l, as depicted by the double-headed horizontal arrow in FIG. 1.

A support portion 10 of the grinder 2, for supporting the piece of feedstock 4, includes a bushing 18 for bracing the piece of feedstock 4 to prevent it from losing its rigidity during grinding. During grinding, a grinding wheel 16 is positioned in a gap 14, between the bushing 18 and the collet 6*b*, to contact the piece of feedstock 4. The piece of feedstock 4 is ground to a cross-sectional diameter determined by the relative positions of the grinding wheel and the longitudinal axis l.

One problem with conventional OD grinders is that they cannot efficiently grind wires of small diameter. In particular, a grinding wheel with a wide grinding-surface width cannot be used to grind fine wires, because the wide surface causes distortion (bending) of the wires during grinding. Therefore, only narrow grinding wheels can be used, which cannot remove large amounts of material quickly, thus making the process of grinding fine wires slow and inefficient.

Further, conventional OD grinders generally cannot continuously grind a profile over an arbitrarily long length of feedstock, because the lateral travel distance of the collets 6*a*, 6*b* holding the piece of feedstock 4 is limited.

FIGS. 2A–2C schematically show a perspective view, a front view, and a top view, respectively, of a conventional centerless grinder 22. The centerless grinder 22 grinds the outer surface of feedstock 24 by guiding the feedstock 24 between two grinding wheels: a work wheel 26 and a regulating wheel 28, as shown in FIG. 2A. A support piece 8 supports the feedstock 24 during grinding, as shown in FIG. 2B. The grinding wheels rotate in the same direction at different speeds, and have respective peripheral portions that face each other, as shown in FIG. 2C. The diameter of the ground product is controlled by controlling a gap separating the two peripheral portions. One of the grinding wheels, typically the regulating wheel 28, is movable and is used to vary the diameter of the feedstock 24 during grinding. By tilting the rotational axis of one grinding wheel relative to the other grinding wheel, the feedstock 24 is caused to move forward through the grinder 22.

The feed rate, or the rate at which the feedstock 24 advances through the grinder 22, is affected by several factors, including temperature, tilt angle, rotation speed of the regulating wheel 28, slippage (if any) between the regulating wheel 28 and the feedstock 24, feedstock material and its cross-sectional area, and rotational speed of the regulating wheel 28. Because of the numerous factors, the feed rate and, thus, the longitudinal position of the feedstock 24, can be difficult to accurately control and, therefore, such difficulty can detrimentally affect the dimensional accuracy of the ground product. For example, if precise tapers are desired, such that a length of feedstock linearly decreases in diameter, variations in the feed rate and longitudinal position can detrimentally affect the linearity of the tapered profile, the length of the taper, as well as the length of barrel sections before and after the taper.

U.S. Pat. No. 5,480,342 ('342) describes a centerless grinder in which the feed rate is controlled by using a series of photoelectric sensors to detect the movement of the trailing edge of a piece of feedstock as it is being ground. Each sensor is positioned along a line parallel to the line of travel of the feedstock, and the sensors are spaced apart at known distances. As the trailing edge goes past a sensor, that sensor produces a signal that is sent to a microprocessor. The microprocessor calculates the feed rate based on the known distance between each sensor and the times at which the trailing edge passes each sensor. For example, if the trailing edge passes sensor 1 at time t1 and passes sensor 2 at time t2, and sensor 1 and sensor 2 are located a distance d apart, then the feed rate during interval 1 (between sensor 1 and sensor 2) is d/(t2–t1). Similarly, if the trailing edge passes sensor 3 at time t3, the feed rate during interval 2 (between sensor 2 and sensor 3) is d/(t3–t2). The feed rates are calculated by the microprocessor, and a comparison of the feed rates during interval 1 and interval 2 provides a value that is used by the microprocessor to control, for example, the position of the regulating wheel to thereby control the diameter of the feedstock along its length during grinding.

The prior art also proposes the use of a slidable sensor assembly for precision grinding of long pieces of feedstock. The sensor assembly is slidable and is set in a position corresponding to the trailing edge of the piece of feedstock. Such an arrangement enables the precision grinding of a section of the piece of feedstock, but is not conducive to precision grinding an arbitrarily long piece of feedstock along its entire length. This is because sensors are not provided along the entire travel length of the piece of feedstock but instead are provided only on the sensor assembly, which limits the precision grinding to be performed only on a section corresponding to the length of the sensor assembly.

One drawback of the conventional centerless grinders described above is that the length and/or diameter of the ground product can be accurately controlled only where the trailing edge of the feedstock falls within the sensing range. Therefore, in order to precisely grind a piece of feedstock of arbitrarily long length to have a desired profile along its entire length, an elongated sensor or a sufficiently long line of sensors is required. Such an arrangement requires not only a large manufacturing area to house the grinder and its associated long sensing line, but also entails the costs of deploying the additional sensing capabilities.

Another drawback of the conventional centerless grinders described above is that they cannot accurately control the longitudinal position of a piece of feedstock. Although the sensors provide a value for the feed rate or position of the feedstock as its trailing edge passes from sensor to sensor, the value is merely and estimate. This is because the feed rate or position of a previous section (a section that has already been ground) is used to predict the feed rate or position of the next section to be ground. Thus, there is an inherent lag in the reaction time of such conventional centerless grinders.

Yet another drawback of conventional centerless grinders is the accuracy of the longitudinal position of the feedstock is controllable to, at best, approximately ±0.030 inch. Therefore, grinding of fine features with dimensional tolerances smaller than about ±0.030 inch is precluded with such conventional grinders.

None of the above-described conventional grinders allows for precision grinding of an arbitrarily long length of feedstock over its entire length. Further, grinding of a continuous spool of feedstock is not possible with a conventional centerless grinder, because there is no trailing edge to detect, and is also not possible with a conventional OD grinder, because of the limited travel distance of the collets. Furthermore, conventional grinders provide only modest control over the longitudinal position of the feedstock, thus limiting their use to grinding articles with large to moderate dimensional tolerances.

SUMMARY OF INVENTION

The present invention overcomes the shortcomings of conventional OD and centerless grinders by providing a system for continuously grinding feedstock of indefinite length to precise dimensions of circular cross section. The system automatically produces a ground product with a precise cross-sectional diameter that may be fixed, that gradually changes along the length of the feedstock, and/or that abruptly changes in a step-like manner along the length of the feedstock.

According to an aspect of the present invention, the system includes a transport apparatus adapted to continuously and controllably transport feedstock of an arbitrarily long length at a desired feed rate, a grinding apparatus adapted to grind the feedstock transported by the transport apparatus, and a controller adapted to control a grinding position of the grinding apparatus and a longitudinal position of the feedstock during grinding.

According to another aspect of the present invention, a method of continuously grinding elongate feedstock is provided. The method includes the steps of: (i) continuously and controllably transporting, using a transport apparatus, feedstock of an arbitrarily long length at a desired feed rate; (ii) grinding the feedstock transported by the transport apparatus, using a grinding apparatus; and (iii) controlling a grinding position of the grinding apparatus and a longitudinal position of the feedstock during grinding.

According to yet another aspect of the present invention a grinding system for grinding elongate feedstock is provided. The grinding system includes a transport apparatus adapted to continuously and controllably transport feedstock of an arbitrarily long length at a desired feed rate using a plurality of carriages for moving the feedstock. The feed rate is controlled by controlling movement of the plurality of carriages. The system also includes a grinding apparatus adapted to grind the feedstock transported by the transport apparatus, and a controller adapted to control a grinding position of the grinding apparatus and a longitudinal position of the feedstock during grinding.

According to still another aspect of the present invention, a method of grinding elongate feedstock is provided. The method includes: (i) continuously and controllably transporting, using a transport apparatus, feedstock of an arbitrarily long length at a desired feed rate, wherein the transport apparatus comprises a plurality of carriages for moving the feedstock, and wherein the transport apparatus controls the feed rate by controlling movement of the plurality of carriages; (ii) grinding the feedstock transported by the transport apparatus, using a grinding apparatus; and (iii) controlling a grinding position of the grinding apparatus and a longitudinal position of the feedstock during grinding, using a controller.

According to another aspect of the present invention, a centerless grinding apparatus is provided. The apparatus includes a work wheel for grinding feedstock, a bottom support unit for providing bottom support to the feedstock during grinding, and a back support unit for providing back support to the feedstock during grinding. The bottom support unit is movable relative to the back support unit, and the bottom support unit and the back support unit are formed with a plurality of projections that intermesh.

These and other object, features, and advantages will be apparent from the following description of the preferred embodiments of the present invention.

BRIEF DESCRIPTION OF THE DRAWINGS

The present invention will be more readily understood from a detailed description of the preferred embodiments in conjunction with the following figures.

DETAILED DESCRIPTION OF THE PREFERRED EMBODIMENTS

Figure 1:
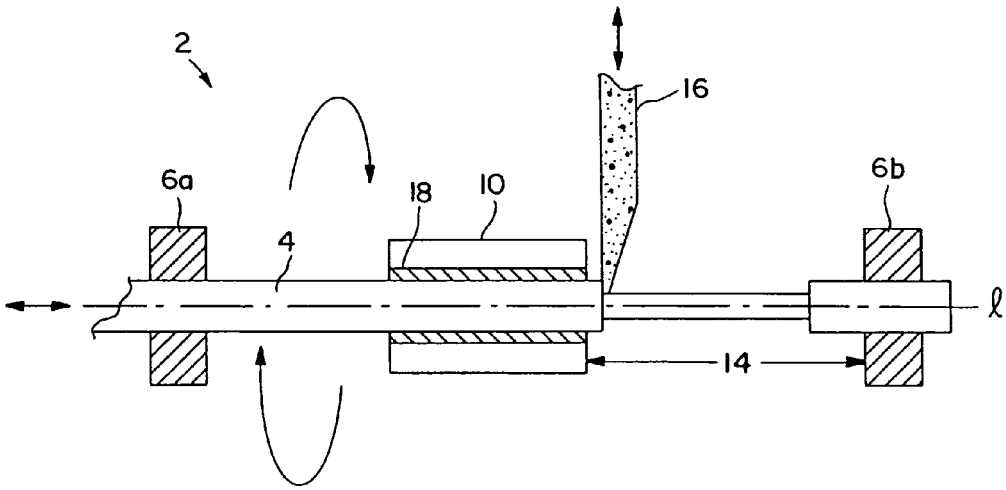
FIG. 1 PRIOR ART
FIG. 1 is a sectional view of a conventional OD grinder.
Figure 2A:
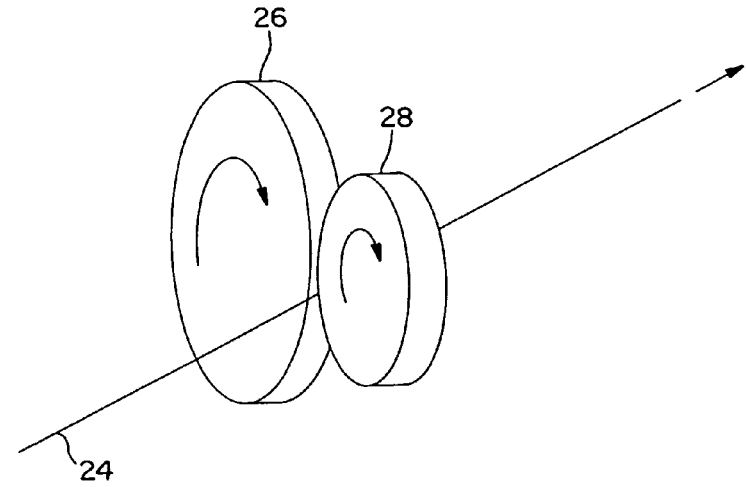
FIG. 2A PRIOR ART
FIG. 2A is a schematic perspective view.
Figure 2B:
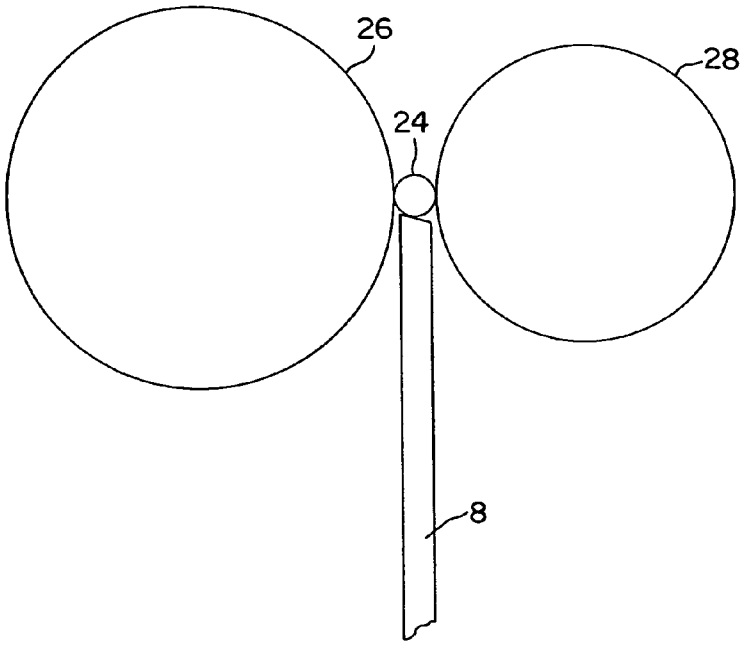
FIG. 2B PRIOR ART
FIG. 2B is a schematic front view.
Figure 2C:
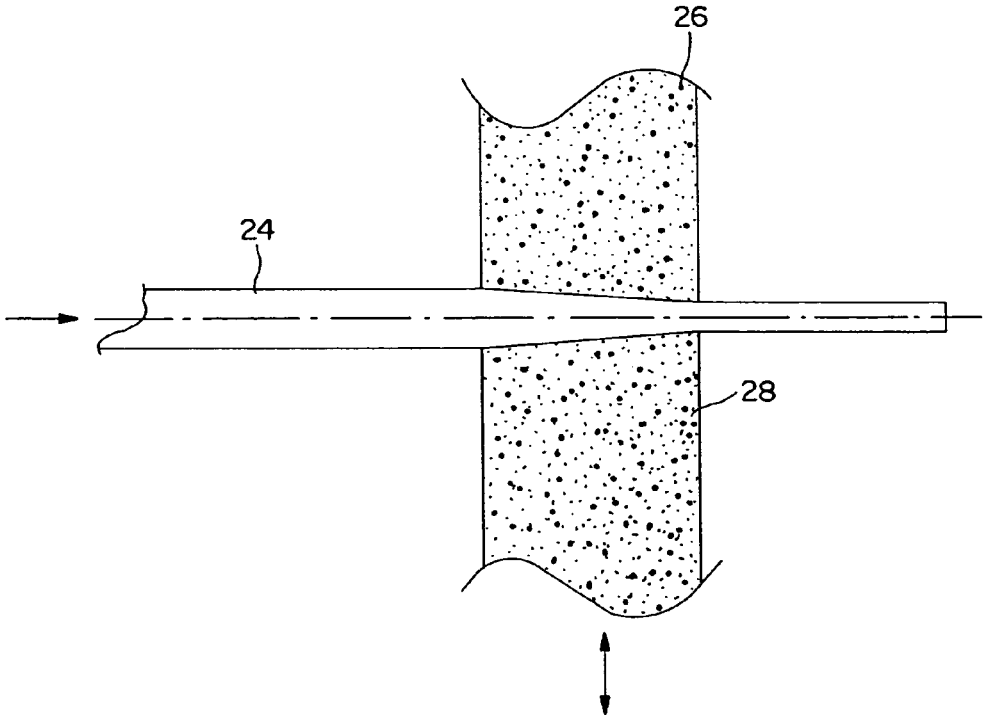
FIG. 2C PRIOR ART
FIG. 2C is a schematic top view of a conventional centerless grinder.
Figure 3:
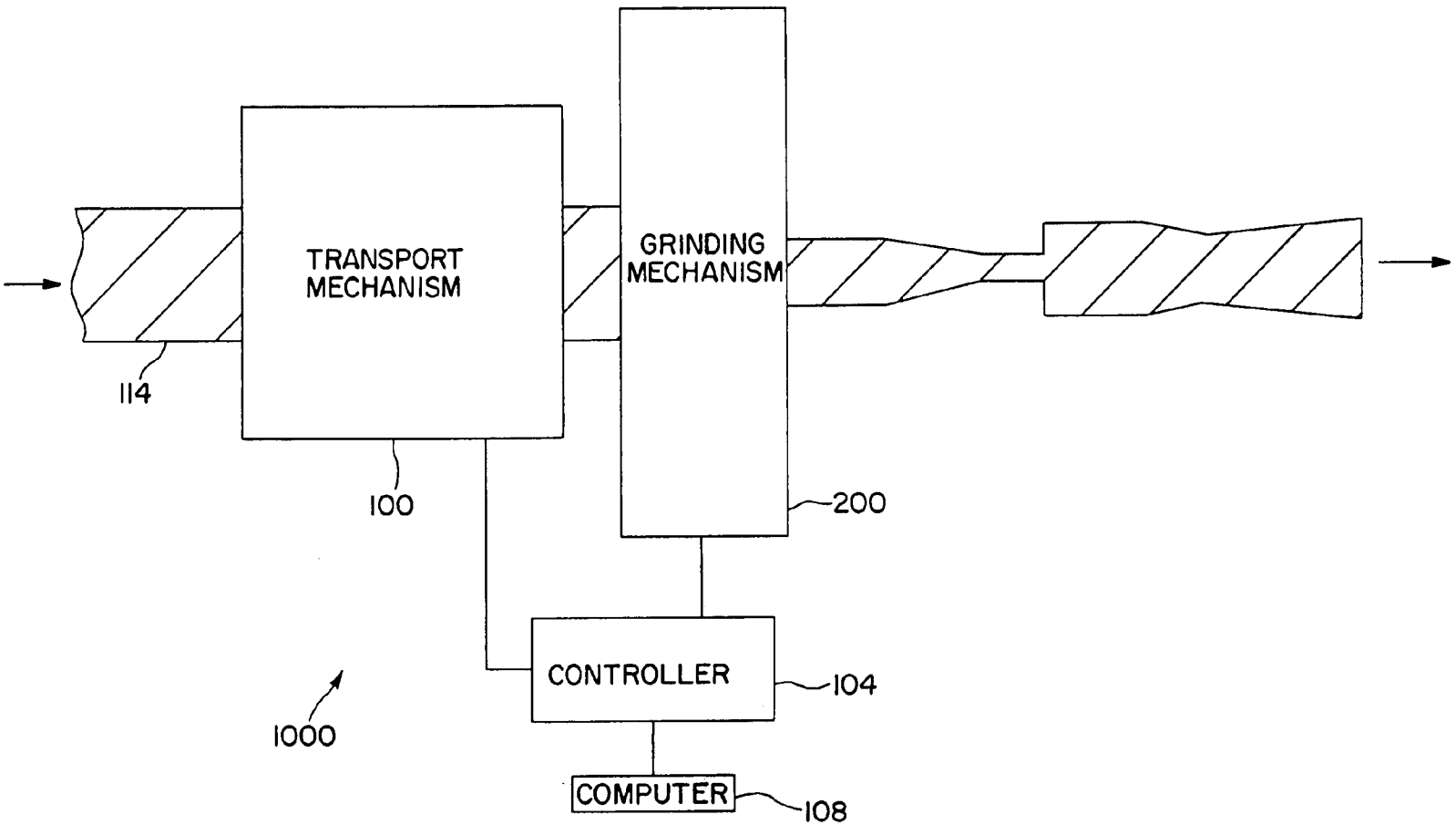
FIG. 3 schematically illustrates a grinder system according to an embodiment of the present invention.

FIG. 3 schematically illustrates a grinder system 1000 according to an embodiment of the present invention. The grinder system 1000 includes a transport mechanism 100, which can precisely control the feed rate and longitudinal position of an arbitrarily long length of feedstock 114, and a grinding mechanism 200. A multi-axis controller 104 controls the transport mechanism 100 and provides position control to the grinding mechanism 200.

Figure 4A:
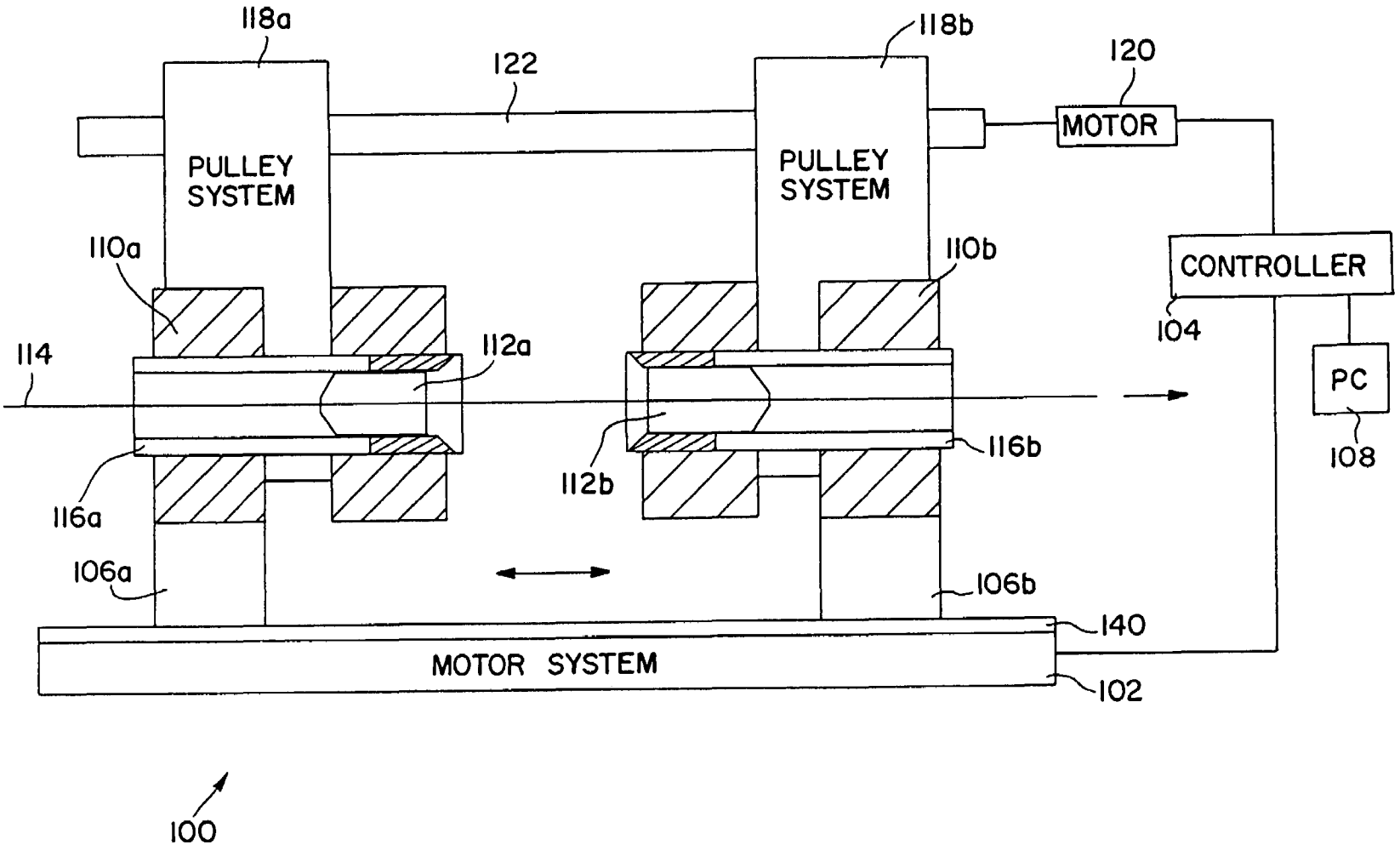
FIG. 4A schematically shows a transport mechanism according to an embodiment of the present invention, and FIG. 4B schematically shows a collet assembly of the transport mechanism.

The transport mechanism 100, schematically shown in FIG. 4A, includes a linear servo motor system 102, for example, a Parker™ 802-2849 motor system with a 0.1 $\mu$m linear scale, controlled by the controller 104. For example, the controller 104 may be a Parker Compumotor™ 6K6 or 6K8 controller, or a control system that provides coordinated outputs to the transport mechanism 100 and the grinding mechanism 200. The motor system 102 drives two carriage assemblies 106*a*, 106*b* to move along a track 140, in directions indicated by the horizontal doubled-headed arrows.

The controller 104 is equipped with a microprocessor (not shown) for processing a control program and control-data files stored in an internal memory (not shown) of the controller 104. The control program and the control-data files may be downloaded to the memory via a programmable computer 108, which is connected to the controller 104 directly or via a network.

It should be understood that, although the use of two carriage assemblies is described herein, the scope of the present invention encompasses the use of more than two carriages assemblies.

Figure 4B:
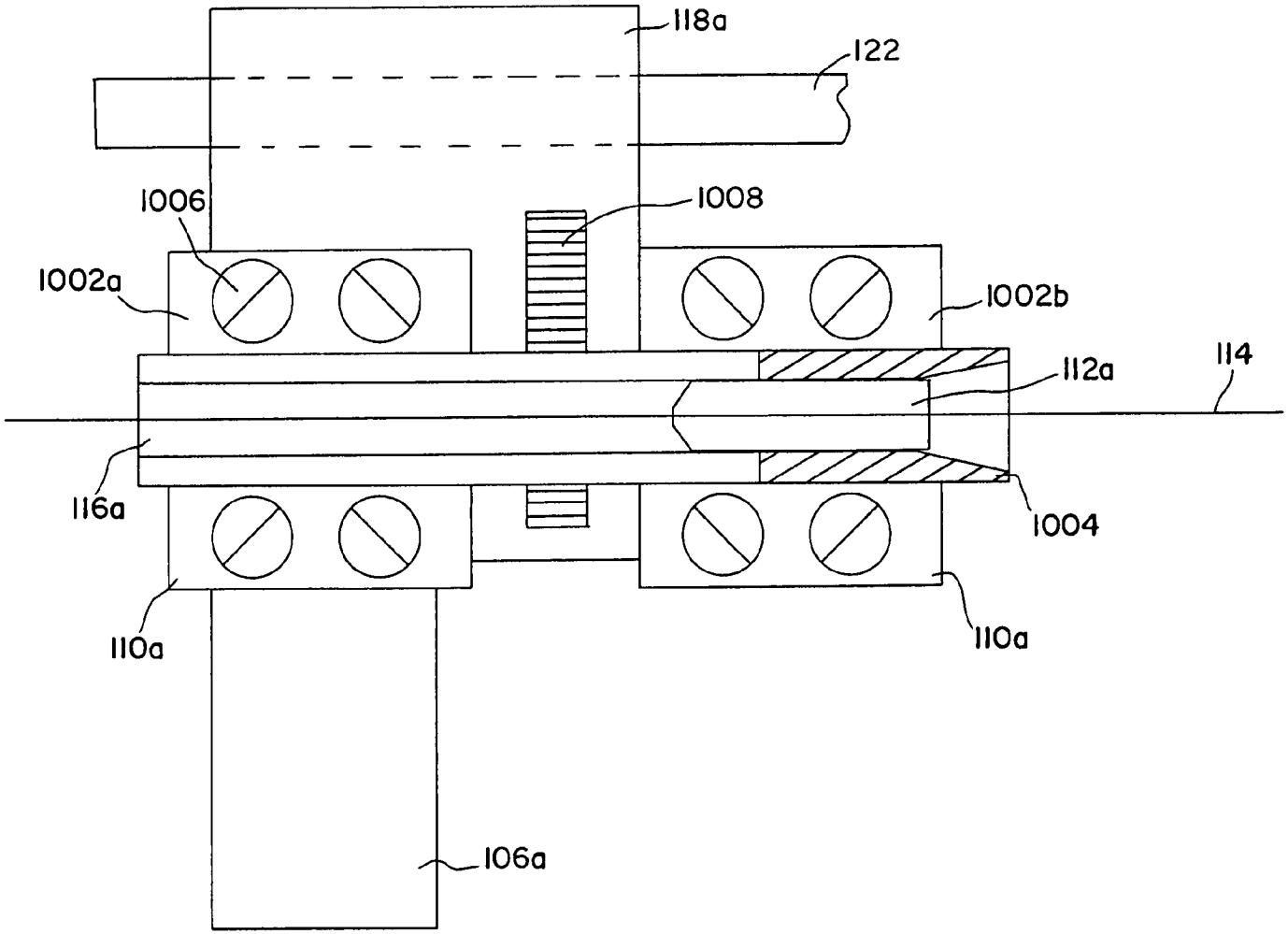

Each carriage assembly 106*a*, 106*b* supports a respective collet assembly 110*a*, 110*b*. Details of the collet assembly 110*a* are schematically shown in FIG. 4B. The collet assembly 110*b* is conceptually the same as the collet assembly 11*a*.

As shown in FIG. 4B, the collet assembly 110*a* is formed of two portions 1002*a*, 1002*b*, each of which are arranged around a drawbar 116*a*. Bearings 1006 are provided on the collet assembly 110*a* to enable the drawbar 116*a* to rotate relative to the collet assembly 110*a*.

Between the portions 1002*a*, 1002*b* of the collet assembly 110*a* is a pulley mechanism 118*a* of a rotation system, which will be described later. The pulley mechanism 118*a* provides the rotational driving force for rotating the drawbar 116*a* via action of a pulley device 1008.

Within the drawbar 116*a* is a collet 112*a* and a sleeve 1004. For example, the collet 112*a* may be a Levin™ collet, which opens and closes by using compressed air to move the sleeve 1004 back and forth over the collet 112*a*. The collet 112*a* is normally in an opened position, with the sleeve 1004 in a retracted position, and is closed when the sleeve 1004 is positioned to surround the collet 112*a*. Compressed air is used to provide the force to move the sleeve 1004 to close the collet 112*a*. A compressed-air valve (not shown), is activated to an opened or closed position by signals from the controller 104.

It should be understood that the present invention is not limited to the use of a compressed-air mechanism for opening and closing the collet 112*a*, and the scope of the present invention encompasses other mechanisms, including electromagnetic, ferro-fluidic, and hydraulic mechanisms.

Feedstock 114 to be ground by the system 1000 is fed through an axial opening of drawbar 116*a* and through the collet 112*a*, which alternately grips and releases the feedstock 114 while rotating and moving reciprocally to control the movement of the feedstock 114 and its longitudinal position during grinding. When the collet 112*a* is in an opened position, it can move with respect to the feedstock 114; when in a closed position, the collet 112*a* holds the feedstock 114 and moves together with it.

The drawbar 116*a* is generally tubular in shape, but may also have other shapes as long as an opening or cut-out is provided through which the feedstock 114 is fed. The drawbar 116*a* and the collet 112*a* rotate together and also move in the longitudinal direction (along the axis of the feedstock 114) together.

One portion 1002*b* of the collet assembly 110*a* is slidable relative to the feedstock 114, and is connected to the sleeve 1004. When compressed air is applied, the sleeve 1004 along with the portion 1002*b* of the collet assembly slide along the drawbar 116*a*, such that the sleeve 1004 surrounds the collet 112*a* and the collet 112*a* is closed to grip the feedstock 114. The other portion 1002*a* of the collet assembly 110*a* is attached to the carriage assembly 106 and remains stationary when the collet 112*a* opens and closes.

Thus, the drawbar 116 connects the portions 1002*a*, 1002*b* of the collet assembly, with the portion 1002*a* being longitudinally fixed with respect to the drawbar 116*a*. The slidable portion 1002*b* of the collet assembly 110*a*, along with the sleeve 1004, slide along the drawbar 116*a* to open and close the collet 112*a*. By virtue of this arrangement, when the collet 112 is opened or closed, the change in pressure of the compressed air causes the slidable portion 1002*b* of the collet assembly 110*a* and the sleeve 1004 to move, without affecting the longitudinal position of the collet 112*a*. In this way, pressure changes that occur during the opening and closing of the collet 112*a* do not cause inadvertent movement of the collet 112*a* along the longitudinal axis of the feedstock 114 and, thus, will not cause a spurious change in the longitudinal position of the feedstock 114 along the track 140 during grinding.

The drawbars 116*a*, 116*b* are connected to a rotation system that causes them as well as the collets 112*a*, 112*b* to synchronously rotate around their central axis. The rotation system includes friction-drive pulley systems 118*a*, 118*b*, which are connected to each other by a common shaft 122, and a motor 120, as schematically shown in FIG. 4A. The motor 120 rotates the shaft 122, which causes the pulley systems 118*a*, 118*b* to rotate the drawbars 116*a*, 116*b* and the collets 112*a*, 112*b*.

Optionally, the motor 120 drives one of the pulley systems 118*b*, which causes the drawbar 116*b* and its corresponding collet 112*b* to rotate, and also causes the shaft 122 to rotate. Rotation of the shaft 122 causes the other pulley system 118*a* to move, which causes the other drawbar 116*a* and its corresponding collet 112*a* to rotate.

Typically, the rotation speed ranges from about 0 to 90 revolutions per second or above. The pulley system 118*b* and the shaft 122 move longitudinally along with the collet assembly 110*b*. The pulley system 118*a* moves longitudinally along with the collet assembly 110*b*, and includes slidable bearings, such as those available from Thompson Industries™, to enable it to slide along the shaft 122.

The rotation of the collets 112*a*, 112*b* causes the feedstock 114 to rotate during grinding. The shaft 122 maintains the rotation synchronicity of both collets 112*a*, 112*b*, thus preventing the feedstock 114 from twisting. The motor 120 is controlled by an axis of the controller 104.

The pulley systems 118*a*, 118*b*, as shown are standard belt-driven systems, and their detailed implementation is within the realm of one of ordinary skill in the art. Therefore, a detailed description thereof has been omitted.

It should be understood that the present invention is not limited to the rotation scheme described above, and the scope of the present invention encompasses other schemes for rotating the feedstock 14.

During operation, the controller 104 runs a program that controls the motor system 102, provides commands to open and close the collets 112*a*, 112*b*, controls the motor 120 driving the rotation system, and controls a grinding position of the grinding mechanism 200, as discussed later.

The motor system 102 moves the carriage assemblies 106*a*, 106*b* back and forth on the track 140. At any time during grinding of the feedstock 114, at least one of the col-lets 112*a*, 112*b* is in the closed position and moves the feedstock 114 in a forward direction at a feed rate and a longitudinal position set by the controller 104. When the first carriage assembly 106*a* reaches the end of its travel span, a signal is sent from the controller 104 to open the first collet 112*a*, thus causing it to release its hold on the feedstock 114. The motor system 102, under control of the controller 104, then causes the first carriage assembly 106*a* to move backward along the track 140 for a set distance, thus causing the first collet assembly 110*a*, including the first drawbar 116*a* and the first collet 112*a*, to move backward by that distance. The controller 104 then sends a signal to close the first collet 112*a*, thus causing it to grasp the feedstock 114 at a new position upstream from where the first collet 112*a* released the feedstock 114. The controller 104 then controls the motor system 102 to move the first carriage assembly 106*a* forward along the track 140 at the same rate of forward motion as that of the second carriage 106*b* assembly.

At the same time that the first carriage assembly 106*a* changes direction to grasp an upstream section of the feedstock 114, the second carriage assembly 106*b* has not yet reached the end of its travel span. Therefore, the second collet 112*b* maintains its hold on the feedstock 114, thus maintaining the rotation of the feedstock 114 and the forward motion of the feedstock 114 at the set feed rate, thus controlling the longitudinal position of the feedstock 114 and avoiding any lapses in position control.

Similarly, when the second carriage assembly 106*b* reaches the end of its travel span, a signal is sent from the controller 104 to open the second collet 112*b*, thus causing it to release its hold on the feedstock 114. The motor system 102, under control of the controller 104, then causes the second carriage assembly 106*b* to move backward along the track 140 for a set distance, without interfering with the first carriage assembly 106*a*, thus causing the second collet assembly 10*b*, along with the second drawbar 116*b* and the second collet 112*b*, to move backward by that distance. The controller 104 then sends a signal to close the second collet 112*b*, thus causing the second collet 112*b* to grasp the feedstock 114 at a new position upstream from where the second collet 112*b* released the feedstock 114. The controller 104 then controls the motor system 102 to move the second carriage assembly 106*b* forward along the track 140 at the same rate of forward motion as that of the first carriage assembly 106*a*.

At the same time that the second carriage assembly 106*b* changes direction to grasp an upstream section of the feedstock 114, the first carriage assembly 106*a* has not yet reached the end of its travel span. Therefore, the first collet 112*a* maintains its hold on the feedstock 114, thus maintaining the rotation of the feedstock 114 and the forward motion of the feedstock 114 at the set feed rate, thus controlling the longitudinal position of the feedstock 114 and avoiding any lapses in position control.

By setting the carriage assemblies 106*a*, 106*b* such that at least one of them is moving forward along the track 140 during grinding of the feedstock 114, the longitudinal position of the feedstock 114 is controlled and the feedstock 114 moves forward continuously at the set feed rate by at least one of the collets 112*a*, 112*b*. The collets 112*a*, 112*b*, alternately release hold of the feedstock 114 and move backward along the track 140 to grasp an upstream section of the feedstock 114 to thus advance the feedstock 114 without any discontinuity in its rotational and forward motion. In operation, the transport mechanism 100 described above is somewhat reminiscent of the motion of two inch-worms.

Figure 5:
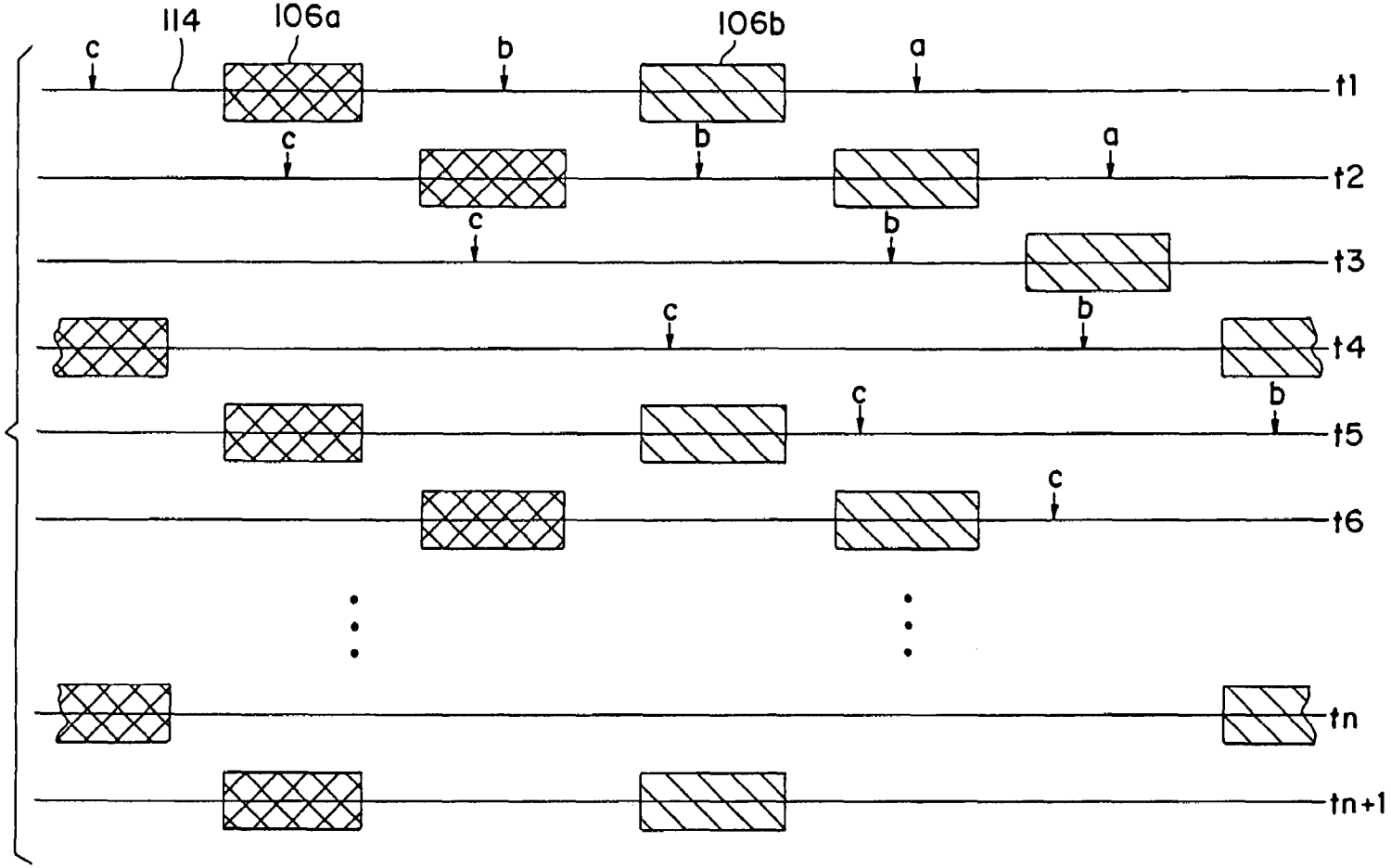
FIG. 5 schematically illustrates the positions of carriage assemblies of the transport mechanism of FIG. 4 at various times during a grinding operation.

FIG. 5 schematically illustrates the positions of the carriage assemblies 106*a*, 106*b* at various times during operation of the transport mechanism 100. At t1, the first carriage assembly 106*a* and the second carriage assembly 106*b* are at their respective positions, as shown, and the first and second collets 112*a*, 112*b* are closed around the feedstock 114. Position markers a, b, and c indicate relative positions on the feedstock 114 as it advances in the forward direction indicated by the arrowheads. At t2, the first carriage assembly 106*a* is at the end of its travel span, while the second carriage assembly 106*b* has not yet reached the end of its travel span. The first collet 112*a* releases its hold of the feedstock 114 at this time and subsequently begins moving backward along the track 140. At the same time, the second carriage assembly 106*b* continues its forward motion, with the second collet 112*b* providing the rotational and forward-motion driving forces. At t3, the first carriage 106*a* is at the beginning of its travel span. The first collet 112*a* closes around the feedstock 114 at this time and beings moving forward along the track 140. At the same time, the second carriage assembly 106*b* continues it forward motion. At t4, the second carriage assembly 106*b* is at the end of its travel span, while the first carriage assembly 106*a* has not yet reached the end of its travel span. The second collet 112*b* releases its hold of the feedstock 114 at this time and subsequently begins moving backward along the track 140. At the same time, the first carriage assembly 106*a* continues its forward motion, with the first collet 112*a* providing the rotational and forward-motion driving forces.

As illustrated in FIG. 5, the feedstock 114 is advanced continuously by the action of the transport mechanism 100, which enables the longitudinal position of an arbitrarily long or continuous length of the feedstock 114 to be controlled and the feedstock 114 to advance at a controlled feed rate. In other words, the transport mechanism 100 can continuously advance feedstock of any length at a controlled feed rate and with control of its longitudinal position.

As mentioned above, the motor system 102 is a linear servo motor system, which independently moves the carriage assemblies 106*a*, 106*b* to advance the feedstock 114 through the grinding system 1000 at a controlled feed rate and with control of its longitudinal position. It should be understood, however, that the scope of the present invention also encompasses the use of motor systems other than a linear servo motor system for causing reciprocating movement of the carriage assemblies 106*a*, 106*b*, such as a stepper motor system, for example.

The transport mechanism 100 provides a number of benefits. First, the transport mechanism 100 continuously advances the feedstock 114 by at a controlled feed rate. This enables an arbitrarily long length of feedstock to be ground without stopping, thus enabling continuous processing of multiple ground articles, one after another, in a chain-like manner. The "chained" articles can be easily separated after the grinding process has been completed. Accordingly, the transport mechanism 100 increases the efficiency in mass production of ground articles.

Second, the transport mechanism 100 has a relatively small "footprint," because the carriage assemblies 106*a*, 106*b* travel back and forth within their respective travel spans to advance the feedstock 114. There is no need to provide floor space for a long line of sensors, as in certain conventional grinders described above. Accordingly, a more efficient use of space at a grinding facility is possible with the transport mechanism 100.

Third, the transport mechanism 100 continuously advances the feedstock 114 by controlling the longitudinal position of the feedstock 114. This enables an intricate profile to be ground into an arbitrarily long length of feedstock in a repeatable manner, thus enabling continuous processing of multiple ground articles with fine details, such as threads or fine spirals. Accordingly, the transport mechanism 100 enables mass production of ground articles with fine features.

Fourth, the transport mechanism 100 is able to move the feedstock 114 in a forward longitudinal direction and a backward longitudinal direction, while maintaining control over the longitudinal position of the feedstock. This enables the feedstock 114 to be ground in multiple passes. For example, when advancing in the forward direction, the feedstock 114 may be ground in a "coarse" pass, where large amounts of material are removed. When moving in the backward direction, the feedstock 114 may then be ground in a "finishing" pass, where fine details are formed from the coarse-ground feedstock 114. Accordingly, the transport mechanism 100 enhances the efficiency of manufacturing ground articles, by coarsely removing large amounts of material at high grinding speeds, and then forming fine features on the coarsely-ground feedstock 114 at speeds commensurate with the level of detail required.

As described above, the transport mechanism 100 is used to control the rotation, longitudinal position, and feed rate of feedstock 114 during grinding. Therefore, the transport mechanism 100 and the grinding mechanism 200 generally are located proximate one another, as schematically shown in FIG. 3.

Figure 6:
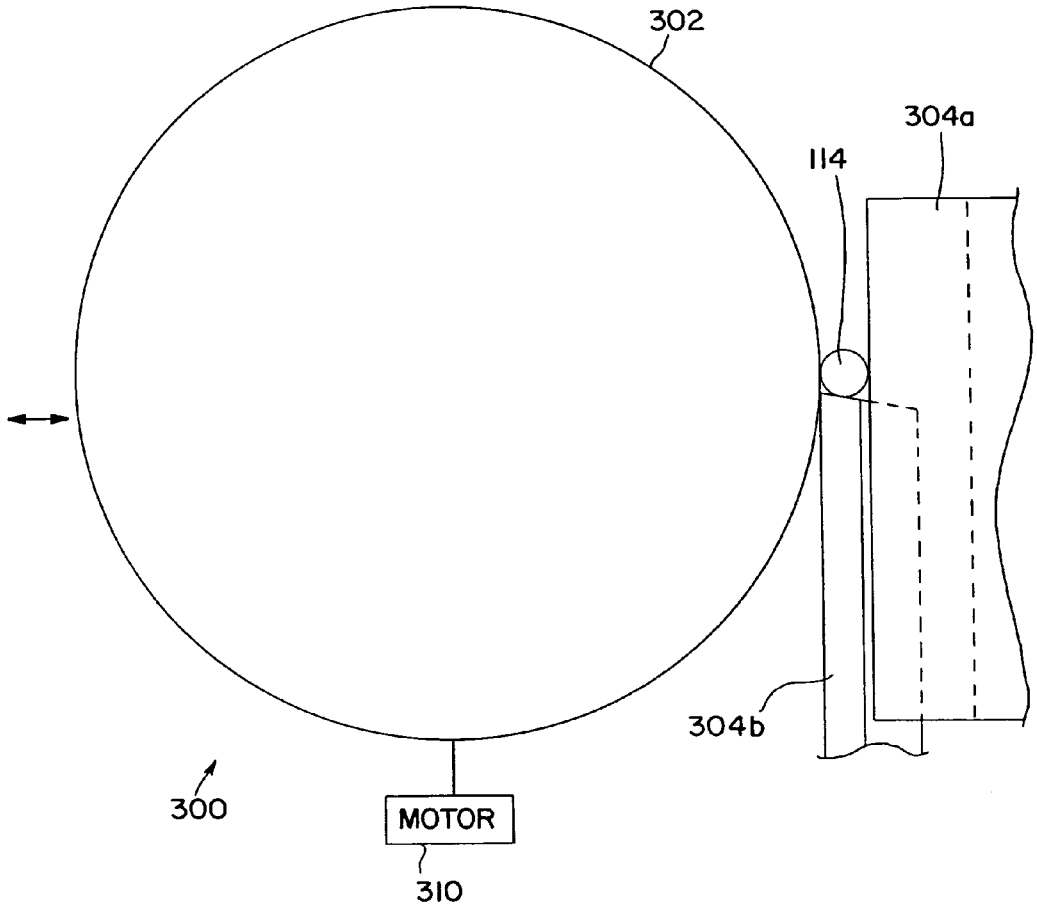
FIG. 6 schematically shows a front view of a grinding mechanism according to an embodiment of the present invention.

According to an embodiment of the present invention, the grinding mechanism 200 is a centerless grinder 300, which is schematically shown in the front sectional view of FIG. 6. The grinder 300 includes a work wheel 302, which rotates to grind material from the feedstock 114, and support units 304*a*, 304*b*, which provide physical support to the feedstock 114 during grinding. Unlike the conventional centerless grinders described above, the grinder 300 does not require a regulating wheel.

The support unit 304*a* provides back support to the feedstock 114, and the support unit 304*b* provides bottom support to the feedstock 114. During grinding, the feedstock rests on the bottom support unit 304*b* and is braced by the back support unit 304*a*.

The work wheel 302 is formed with a peripheral cutting portion made of a hard material suitable for grinding the feedstock 114. For example, materials such as cubic boron nitride, aluminum oxide, silicon carbide, diamond, and mixtures thereof may be used for the cutting portion. The type of material used for the cutting portion is selected according to the material to be ground. The work wheel 302 rotates on its axis during grinding, and is also laterally movable relative to the back support unit 304*a*, as shown by the double-headed arrows in FIG. 6. Although not shown in FIG. 6, the bottom support unit 304*b* is physically linked to the work wheel 302 and moves laterally with the work wheel 302, as will be appreciated from the depictions of FIGS. 7 and 8, and the dotted lines in FIG. 6. The rotation of the work wheel 302 is driven by a motor 310, and the lateral position of the work wheel 302 and the bottom support unit 304*b* is controlled by an axis of the controller 104.

The separation distance between the work wheel 302 and the back support unit 304*a* determines the diameter of the ground feedstock 114. If the separation distance is maintained at a constant value, the ground feedstock 114 will have a constant diameter along its length. If the separation distance changes during grinding, the ground feedstock 114 will have a profile that reflects such changes. For example, if the separation distance starts small and gradually increases, the ground feedstock 114 will have a profile that gradually widens, resulting in a taper. The controller 104, by controlling the lateral position of the work wheel 302 and the longitudinal position of the feedstock 114, controls the profile of the ground feedstock 114.

Figure 7:
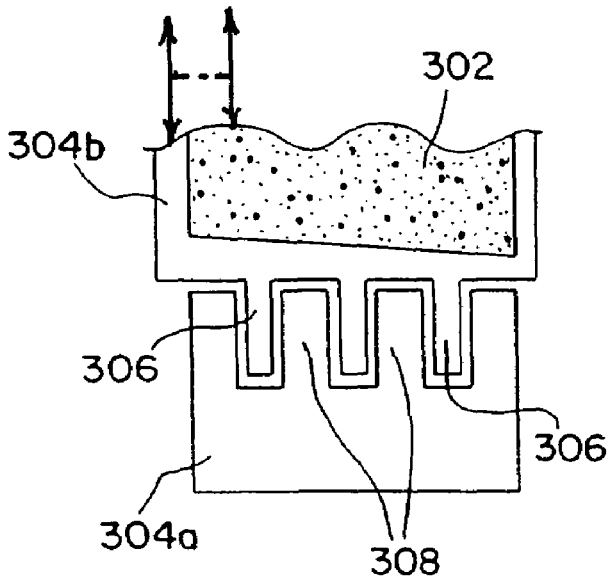
FIG. 7 schematically shows a positional relationship between a work wheel and a support unit of the grinding mechanism of FIG. 6.

FIG. 7 schematically shows a top view of the grinder 300. The bottom support unit 304*b* is formed with at least two projections 306 extending toward the back support unit 304*a*. The back support unit 304*a* is formed with at least two projections 308 extending toward the bottom support unit 304*b*. The projections 306 intermesh with the projections 308, as shown.

Figure 8:
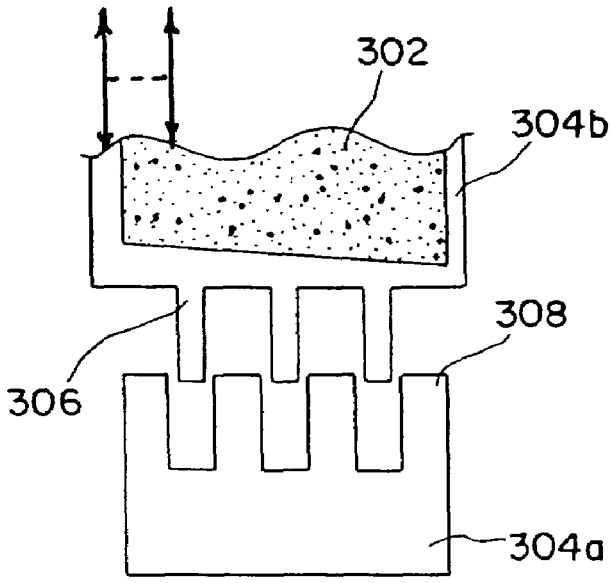
FIG. 8 schematically shows another positional relationship between the work wheel and the support unit of FIG. 7.
Figure 9A:
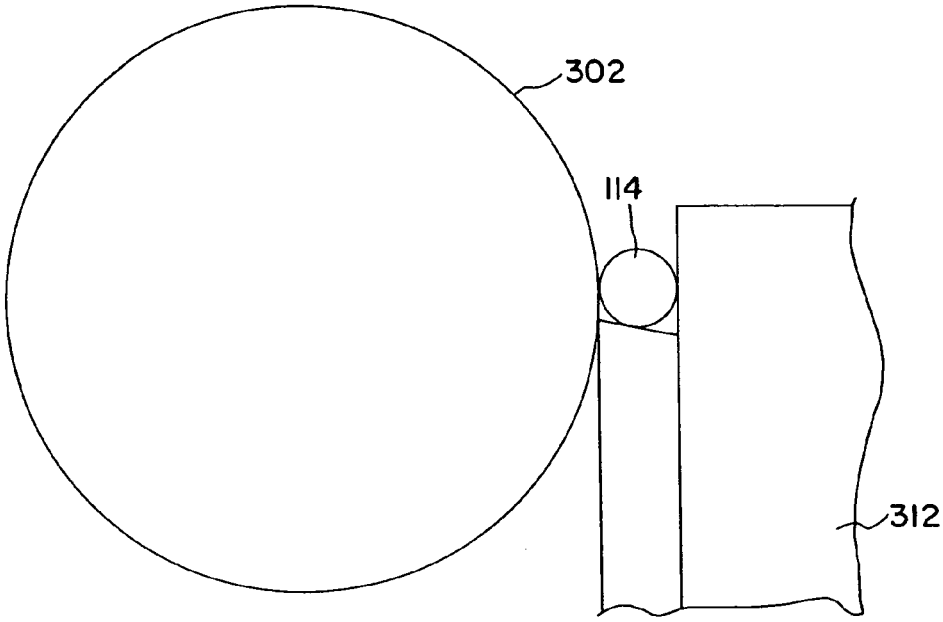
FIGS. 9A and 9B schematically show a view of feedstock ground to a small diameter and a large diameter, respectively.
Figure 9B:
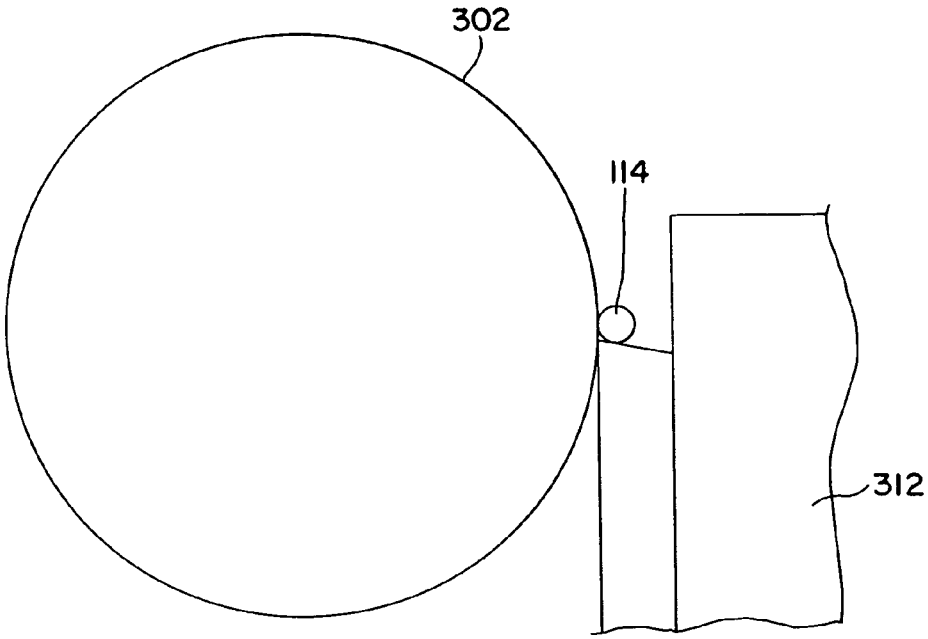

The intermeshed relationship between the projections 306, 308 enable the feedstock 114 to be supported as it is ground to various diameters, large and small. When grinding the feedstock 114 to a relatively small diameter, there is a relatively large overlap between the projections 306, 308, as shown in FIG. 7. When grinding the feedstock 114 to a relatively large diameter, there is a relatively small overlap, or possibly even no overlap, as shown in FIG. 8. One benefit of such an arrangement is that it provides both bottom support and back support to the feedstock 114 regardless of the diameters to which it is ground. Without the intermeshed projections 306, 308, a back support unit 312 suitable for supporting feedstock ground to a large diameter (FIG. 9A) may be inadequate to support feedstock ground to a small diameter (FIG. 9B).

Figure 10:
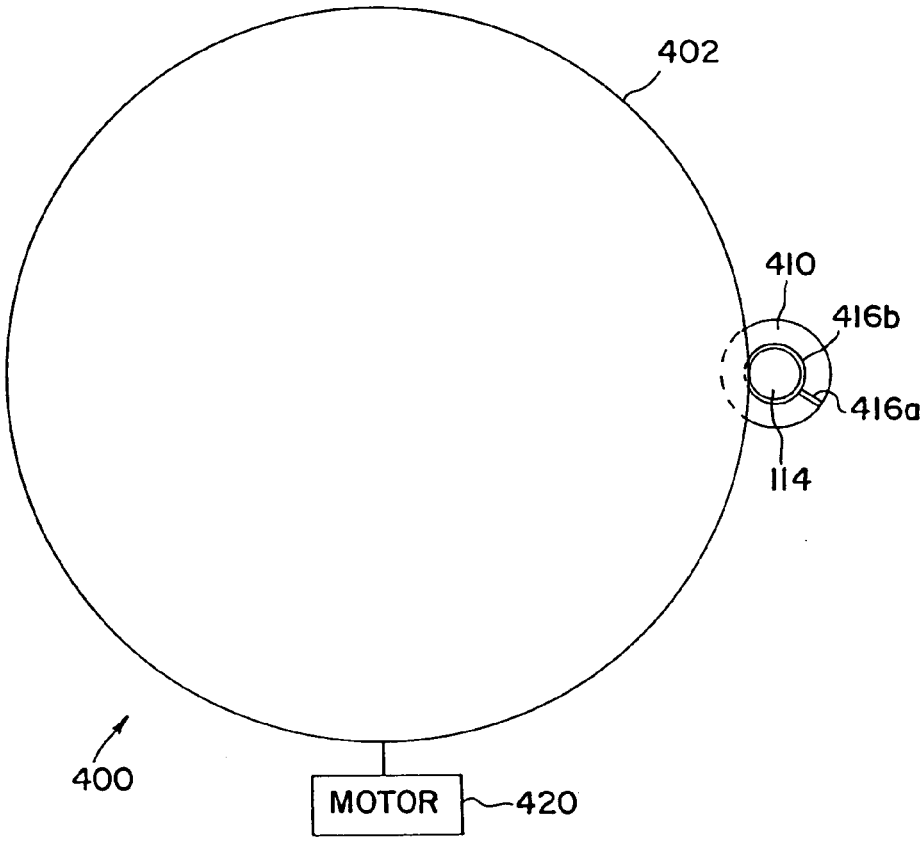
FIG. 10 schematically shows a front view of another grinding mechanism according to an embodiment of the present invention.

According to another embodiment of the present invention, the grinding mechanism 200 of FIG. 3 is an OD grinder 400, which is schematically shown in the front sectional view of FIG. 10.

Figure 11:
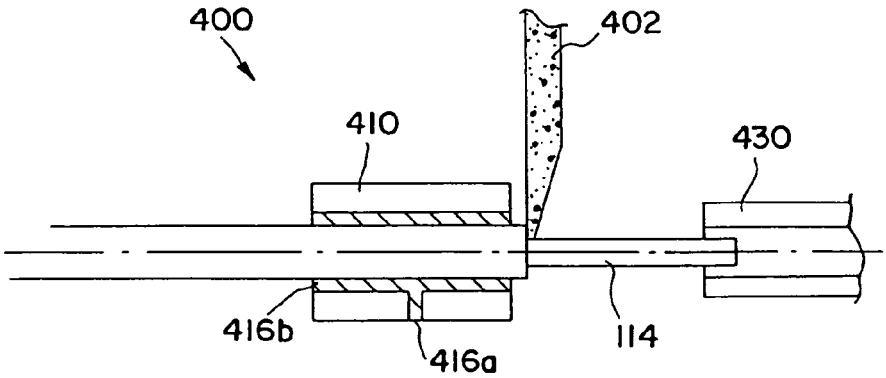
FIG. 11 schematically shows a side sectional view of the grinding mechanism of FIG. 10.

The grinder 400 includes a work wheel 402, which rotates to grind material from the feedstock 114, and a bushing assembly 410, which holds the feedstock 114 in position during grinding, as schematically shown in the side sectional view of FIG. 11. A coolant/lubricant 416*b* is supplied via a duct 416*a* and cools/lubricates the surface of the feedstock 114 during grinding. The coolant/lubricant 416*b* also hydrostatically supports the feedstock 114, allowing it to "float" within the bushing assembly 410. Optionally, a guide piece 430 may be provided to guide and support a ground portion of the feedstock 114.

The work wheel 402 is similar to the work wheel 302 described above in connection with the centerless grinder 300. Therefore, a detailed description of the work wheel 402 has been omitted. The work wheel 402 rotates on its axis during grinding, and is laterally movable relative to the bushing assembly 410. Rotation of the work wheel 402 is driven by a motor 420, and the lateral position of the work wheel 402 is controlled by an axis of the controller 104.

The feedstock 114 is ground to a diameter that is determined by a separation distance between the work wheel 402 and a central axis L of the bushing assembly 410. The controller 104, by controlling the lateral position of the work wheel 402 and the longitudinal position of the feedstock 114, controls the profile of the ground feedstock 114.

During operation, the controller 104 runs a program that controls the motor system 102, provides commands to open and close the collets 112*a*, 112*b*, controls the motor 120 driving the rotation system, and controls a grinding position of the grinding wheel 302 or 402.

The controller 104 is programmed with x,y coordinates, where x corresponds to a longitudinal distance along the feedstock 114, and y corresponds to a position of the work wheel 302 or 402 during grinding. Thus, the controller 104 enables complicated features to be ground into the feedstock 114, such as threads (spirals), because both the position of the feedstock 114 as well as the position of the work wheel 302 or 402 are controlled.

One axis of the controller 104, is dedicated to controlling the motion of the first carriage assembly 106*a*, and another axis of the controller 104, is dedicated to controlling the motion of the second carriage assembly 106*b*. Yet another axis of the controller 104, is a "virtual" axis that links the first and second axes. Physically, no connection is necessary between the motor system 102 and an output connector on the controller 104 for the third axis. Instead, the virtual axis is programmed to correspond to the overall feed rate or x-position of the feedstock 114, which results from the combined motions of the first and second carriage assemblies 106*a*, 106*b*. That is, while the first and second carriage assemblies 106*a*, 106*b*, controlled by respective axes of the controller 104, alternately move backward and forward, the net effect of the movement of both carriage assemblies 106*a*, 106*b* is the continuous advancement of the feedstock 114 forward along the track 140 at a feed rate or x-position controlled by the virtual axis.

The virtual axis is established using a "position following" or "cam" routine stored in a memory of the controller 104. Additionally, a master/slave routine is used, where the axes controlling the first and second carriage assemblies 110*a*, 110*b* are slaves to the master virtual axis. The cam routine uses as input the x coordinates and a set (inputted) feed rate, and runs a motion routine in which the slave axes control the motion of the first and second carriage assemblies 106*a*, 106*b* such that the overall result is the movement of the feedstock 114 by a distance corresponding to the x-coordinate at the set feed rate.

It should be understood that the program does not require a special algorithm, and any program that accomplishes the above-described controls may be used and is within the realm of one of ordinary skill in the art. One exemplary program is given below in Appendix A. The present invention, however, is not limited to using the program in Appendix A.

In summary, the well-defined feed rate and known longitudinal position of the feedstock 114 provides for high-precision grinding at significant speed improvements compared to the prior art. For example, the grinding system 1000 operates to grind fine features into feedstock advanced at feed rates ranging from about 0.001 inch/sec to 0.1 inch/sec when used with the OD grinder 400, and ranging from about 0.1 inch/sec to 1.0 inch/sec when used with the centerless grinder 300. The transport mechanism 100 controls the accuracy in the longitudinal position of the feedstock 114 to within approximately ±0.001 inch, which is more than a thirty-fold improvement over the positional accuracy of ±0.030 inch of conventional grinding systems.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A centerless grinding apparatus comprising:

a work wheel for grinding feedstock;

a bottom support unit for providing bottom support to the feedstock during grinding;

a back support unit for providing back support to the feedstock during grinding; and a controller for controlling a lateral position of the work wheel relative to the back support unit, wherein the back support unit and the bottom support unit interact to support the feedstock during grinding, wherein the bottom support unit is laterally movable relative to the back support unit, wherein the bottom support unit is physically linked to the work wheel and moves laterally with the work wheel, and wherein a separation distance between the work wheel and the back support unit is varied during grinding such that the feedstock is ground to a diameter that varies along its length.

2. A grinding apparatus according to claim 1, wherein the bottom support unit and the back support unit are formed with a plurality of projections that intermesh.

* * * * *

UNITED STATES PATENT AND TRADEMARK OFFICE

CERTIFICATE OF CORRECTION

PATENT NO. : 6,991,518 B1
APPLICATION NO. : 10/411300
DATED : January 31, 2006
INVENTOR(S) : Robert C. Gleason et al.

It is certified that error appears in the above-identified patent and that said Letters Patent is hereby corrected as shown below:

COLUMN 5

Line 37, "11a." should read --110a.--.

COLUMN 7

Line 13, "col-lets" should read --collets--.
Line 48, "10b," should read --100b,--.

COLUMN 8

Line 34, "it" should read --its--.

COLUMN 12

Line 26, Insert Appendix A after line 26 and before line 27.

APPENDIX A

```
;****Travel Direction
;Axis 1 - (+) = Forward
;         (-) = Backwad
;Axis 2 - (+) = Left
;         (-) = Right
;Axis 3 - (+) = Left
;         (-) = Right
;Axis 4 - (+) = Left
;         (-) = Right
;Axis 6 - (+) away from home = Left
;          (-) towards home   = right
;****Axis Drives
;1DRIVE - Grinder Slide
;2DRIVE - Left Slide
;3DRIVE - Right Slide
;4DRIVE - Virtual Axis for Slide
;5DRIVE - X-Axis Spin
;6DRIVE - Dresser slide
;**** i/o
;out.9  - Collet Left axis 2
;out.10 - Collet Right axis 3
;out.11 - Coolant On/Off
;out.12 - Dresser Motor On/Off
;out.13 - Coolant Pump On/Off
;out.14 - Dresser Cylinder retract is open retract is 0
;out.15 - Vector drive stop
;****Variables used by program
;VAR1 = Feed variable (index Dist)
;VAR2 = Spin Velocity
;VAR3 = Size Adjustment,
```

UNITED STATES PATENT AND TRADEMARK OFFICE

CERTIFICATE OF CORRECTION

PATENT NO. : 6,991,518 B1
APPLICATION NO. : 10/411300
DATED : January 31, 2006
INVENTOR(S) : Robert C. Gleason et al.

It is certified that error appears in the above-identified patent and that said Letters Patent is hereby corrected as shown below:

```
;VAR4 = Trim Back
;VAR5 = Axis 2 load position (internal)
;VAR6 = Axis 3 load position (internal)
;VAR7 = Axis 1 Load Position after cycle (internal)
;VAR8 = Axis one Start Position from home
;VAR9 = Scratch pad
;VAR15 = Feed Speed
;VAR10 = half wire diameter
;VAR11 = Temp holding dist for var1
;VAR12 = Moly position from home WWslide
;VAR13 = Dress Roll Position from home WWslide
;VAR14 = Dresser slide position from home Roller only
;Moly position is a fixed number from roller position
;

SCLA 254000,254000,254000,254000,4000,200000
SCLV 254000,254000,254000,254000,4000,200000
SCLD 254000,1,1,254000,4000,200000
SCALE 1


DEL SETUP
DEF SETUP
COMEXC0
@DRIVE0
LIMLVL000000000000XXXXX1XXXXXXXXXXXXXX
SGP20
SGV0
SGI0
SGILIM0
AXSDEF100000
DRES,10000,10000,254000,4000,25000
```

UNITED STATES PATENT AND TRADEMARK OFFICE

CERTIFICATE OF CORRECTION

PATENT NO. : 6,991,518 B1
APPLICATION NO. : 10/411300
DATED : January 31, 2006
INVENTOR(S) : Robert C. Gleason et al.

It is certified that error appears in the above-identified patent and that said Letters Patent is hereby corrected as shown below:

```
ENCPOL00000
CMDDIR10100
ERES50000,4000,4000,,
;SMPER1
SMPER2
LH0,3,3,0,0,0
MC000010
MA000000
FOLEN000000
1OUT.9-0
1OUT.10-0
1OUT.11-0
1OUT.12-0
1OUT.13-0
1OUT.14-0
1out.15-0
1ANO.25=0
;5%TSKAX5,5
;0%TSKAX1,4
;6%TSKAX1,1
0%TSKAX1,4
5%TSKAX5,5
6%TSKAX1,1
WRITE"~DONE"
END

;Vector off
DEL VOFF
DEF VOFF
1ANO.25=0
T6
1OUT.15-0
END

;Vector on run
DEL VRON
DEF VRON
1OUT.15-1
1ANO.25=10
END
```

UNITED STATES PATENT AND TRADEMARK OFFICE

CERTIFICATE OF CORRECTION

PATENT NO. : 6,991,518 B1
APPLICATION NO. : 10/411300
DATED : January 31, 2006
INVENTOR(S) : Robert C. Gleason et al.

It is certified that error appears in the above-identified patent and that said Letters Patent is hereby corrected as shown below:

```
;Vector on Dress
DEL VDON
DEF VDON
1OUT.15~1
1ANO.25=1
END

DEL MOLPOS
DEF MOLPOS
FOLEN000000
;open cylinder
1OUT.14~0
;check switch
WAIT(1IN.2=B1)
FOLEN00000
;Take dresser to roll position ofset by 3/4"
6DRIVE1
6MC0
6MA1
6V.3
6A2
```

UNITED STATES PATENT AND TRADEMARK OFFICE

CERTIFICATE OF CORRECTION

PATENT NO. : 6,991,518 B1
APPLICATION NO. : 10/411300
DATED : January 31, 2006
INVENTOR(S) : Robert C. Gleason et al.

It is certified that error appears in the above-identified patent and that said Letters Patent is hereby corrected as shown below:

```
6AD2
VAR9=VAR14-0.5
6D(VAR9)
6GO1
WAIT(6AS.24=B1)
1DRIVE1
1MC0
1MA1
1V.3
1A1
1AD1
1D(VAR12)
1GO1
;wait till I get there
WAIT(1AS.24=B1)
;show me position now.
WRITE"~DONE"
END

DEL ROLPOS
DEF ROLPOS
FOLEN000000
;open cylinder
1OUT.14-0
;check switch
WAIT(1IN.2=B1)
6DRIVE1
6MC0
6MA1
6V.3
6A2
6AD2
6D(VAR14)
6GO1
WAIT(6AS.24=B1)
```

UNITED STATES PATENT AND TRADEMARK OFFICE

CERTIFICATE OF CORRECTION

PATENT NO. : 6,991,518 B1
APPLICATION NO. : 10/411300
DATED : January 31, 2006
INVENTOR(S) : Robert C. Gleason et al.

It is certified that error appears in the above-identified patent and that said Letters Patent is hereby corrected as shown below:

```
1DRIVE1
1MC0
1MA1
1V.3
1A1
1AD1
1D(VAR13)
1G01
;wait till I get there
WAIT(1AS.24=B1)
;show me position now.
WRITE"~DONE"
END

DEL DRSHOME
DEF DRSHOME
0%TSKAX1,6
FOLEN000000
LIMLVL000000000000XXXXX1XXXXXXXXXXXXXX
6LH0
6DRIVE1
6HOMV0.1
6HOMA1.00000
6HOMAD1.00000
6HOM1
WAIT(6AS.5=B1)
6D0.25000
```

It is certified that error appears in the above-identified patent and that said Letters Patent is hereby corrected as shown below:

```
6GO1
0%TSKAX1,4
WRITE"~DONE"
END

DEL DRSROL
DEF DRSROL
FOLEN000000
1out.14-0
;check switch
WAIT(1IN.2=B1)
1DRIVE1
6DRIVE1
1MC0
6MC0
;Just move in one tenth at a time
1MA0
1V.01
1D0.0001
1GO1
;move in a tenth
WAIT(6AS.24=B1)
T5
WRITE"~DONE"
END

DEL DRSJG
DEF DRSJG
6DRIVE1
6FOLMAS-1
6FOLRN1.00000
6FOLRD25400
6MC1
6D+1
6FOLEN1
6GO1
END
```

UNITED STATES PATENT AND TRADEMARK OFFICE

CERTIFICATE OF CORRECTION

PATENT NO. : 6,991,518 B1
APPLICATION NO. : 10/411300
DATED : January 31, 2006
INVENTOR(S) : Robert C. Gleason et al.

It is certified that error appears in the above-identified patent and that said Letters Patent is hereby corrected as shown below:

```
DEL DRSAFE
DEF DRSAFE
FOLEN000000
1out.14-0
;check switch
WAIT(1IN.2=B1)
1DRIVE1
1MC0
1MA1
1V.1
VAR9=VAR13-0.375
1D(VAR9)
1GO1
WAIT(1AS.24=B1)
WRITE"~DONE"
END

DEL DRSMOL
DEF DRSMOL
1out.14-0
;turn coolant off
1OUT.11-0
;check switch
WAIT(1IN.2=B1)
FOLEN000000
```

UNITED STATES PATENT AND TRADEMARK OFFICE

CERTIFICATE OF CORRECTION

PATENT NO. : 6,991,518 B1
APPLICATION NO. : 10/411300
DATED : January 31, 2006
INVENTOR(S) : Robert C. Gleason et al.

It is certified that error appears in the above-identified patent and that said Letters Patent is hereby corrected as shown below:

```
1DRIVE1
6DRIVE1
1MC0
6MC0
1MA0
1V.01
1D0.0001
1G01
WAIT(1AS.24=B1)
6DRIVE1
6V.5
6A1
6MA0
;5/8 inch right, then left
6D-0.65
6G01
6D0.65
6G01
WAIT(6AS.24=B1)
WRITE"~DONE"
END

;take slide 1 from safe pt to home
DEL SHOMER
DEF SHOMER
FOLEN000000
1DRIVE1
1MC0
1MA1
1D0
1V.3
1A1
1AD1
1G01
WAIT(1AS.24=B1)
1out.14-1
WRITE"~DONE"
END
```

UNITED STATES PATENT AND TRADEMARK OFFICE

CERTIFICATE OF CORRECTION

PATENT NO. : 6,991,518 B1
APPLICATION NO. : 10/411300
DATED : January 31, 2006
INVENTOR(S) : Robert C. Gleason et al.

It is certified that error appears in the above-identified patent and that said Letters Patent is hereby corrected as shown below:

```
;startup Home to last saved Pos
DEL ASTRT
DEF ASTRT
FOLEN00000
1DRIVE1
1MC0
1V.3
1A1
1AD1
1D(VAR8)
1G01
;1tas
;wait till I get there
WAIT(1AS.24=B1)
;show me position now.
;1TPE
;1tas
;now reset to 1/2 wire diameter
;close the hatch
1out.14-1
1PSET(VAR10)
WRITE"~DONE"
END
```

UNITED STATES PATENT AND TRADEMARK OFFICE

CERTIFICATE OF CORRECTION

PATENT NO. : 6,991,518 B1
APPLICATION NO. : 10/411300
DATED : January 31, 2006
INVENTOR(S) : Robert C. Gleason et al.

It is certified that error appears in the above-identified patent and that said Letters Patent is hereby corrected as shown below:

```
;send slide to wire surface.
DEL WSRFC
DEF WSRFC
1FOLEN0
1MC0
1MA1
1A1
1AD1
1V.1
1D(VAR10)
1G01
WRITE"~DONE"
END

;Axis 5 spin
DEL SPIN
DEF SPIN
COMEXC1
5A100.000
5AD100
5V8
5D-1.000
5MC1
5DRIVE1
T1.000
5G01
END


DEL COPN
DEF COPN
;Open Collets
;Turn Coolant Off
1OUT.11-0
1OUT.9-0
1OUT.10-0
END
```

UNITED STATES PATENT AND TRADEMARK OFFICE

CERTIFICATE OF CORRECTION

PATENT NO. : 6,991,518 B1
APPLICATION NO. : 10/411300
DATED : January 31, 2006
INVENTOR(S) : Robert C. Gleason et al.

It is certified that error appears in the above-identified patent and that said Letters Patent is hereby corrected as shown below:

```
DEL CCLS
DEF CCLS
;Close Collets
;Turn Coolant Off
1OUT.11-0
1OUT.9-1
1OUT.10-1
END

DEL HOMER
DEF HOMER
;close hatch
1out.14-1
COMEXC0
FOLEN00000
DRIVE1
T1.000
LIMLVL000XXXXXXXXXXXXXXXXXXXXXXXXXXXXXXX
;was .01
HOMVF.08
HOMV.3
HOMA1.00000
HOMAD1.00000
HOMZ1
HOMDF0
```

UNITED STATES PATENT AND TRADEMARK OFFICE

CERTIFICATE OF CORRECTION

PATENT NO. : 6,991,518 B1
APPLICATION NO. : 10/411300
DATED : January 31, 2006
INVENTOR(S) : Robert C. Gleason et al.

It is certified that error appears in the above-identified patent and that said Letters Patent is hereby corrected as shown below:

```
COMEXC1
HOM0
T0.050
LIMLVL001XXXXXXXXXXXXXXXXXXXXXXXXXXXXXXXX
T0.300
COMEXC0
WAIT(1AS.5=B1)
WRITE"~DONE"
END

DEL IWHOME
DEF IWHOME
COMEXC0
1OUT.9-0
1OUT.10-0
FOLEN00000
3HOMBAC1
3HOMEDG0
3HOMDF1
3HOMV.30000
3HOMA1.00000
3HOMVF0.10000
2HOMBAC1
2HOMEDG0
2HOMDF1
2HOMV.30000
2HOMA1.00000
2HOMVF0.10000
2DRIVE0
3DRIVE1
T1.000
3HOM1
3D-80000
3V.5
;3GO1
```

UNITED STATES PATENT AND TRADEMARK OFFICE

CERTIFICATE OF CORRECTION

PATENT NO. : 6,991,518 B1
APPLICATION NO. : 10/411300
DATED : January 31, 2006
INVENTOR(S) : Robert C. Gleason et al.

It is certified that error appears in the above-identified patent and that said Letters Patent is hereby corrected as shown below:

```
2DRIVE1
T1.000
2HOM1
;3D+80000
;3GO1
OFFSET
WRITE"~DONE"
END

DEL JG
DEF JG
;open hatch
;1out.14-0
DRIVE1
FOLMAS-1
FOLRN1.00000
FOLRD25400
MC1
;define
1D+1
FOLEN1
GO1
END

DEL OFFSET
DEF OFFSET
```

UNITED STATES PATENT AND TRADEMARK OFFICE

CERTIFICATE OF CORRECTION

PATENT NO. : 6,991,518 B1
APPLICATION NO. : 10/411300
DATED : January 31, 2006
INVENTOR(S) : Robert C. Gleason et al.

It is certified that error appears in the above-identified patent and that said Letters Patent is hereby corrected as shown below:

```
MAX00
DRIVE11111
T1.000
FOLEN00000
MC00000
2A1.00000,1.00000
2V0.30000,0.30000
;2D254000,207000
;2D-40000,10000
;2GO11
2PESET0,0
T1.000
FOLMAS,-44,-44
FOLENX11
;PCOMP PROFILE
PCOMP CAM1
;pcomp cam2
END


DEL LOAD
DEF LOAD
VAR5=2PE
VAR6=3PE
2DRIVE1
3DRIVE1
;was .9,0 .10,1
1OUT.9-0
1OUT.10-0

folen000
;was -130000
;2d-100000      ;,120000
;2go1
folen011

WRITE"~DONE"
END
```

UNITED STATES PATENT AND TRADEMARK OFFICE

CERTIFICATE OF CORRECTION

PATENT NO. : 6,991,518 B1
APPLICATION NO. : 10/411300
DATED : January 31, 2006
INVENTOR(S) : Robert C. Gleason et al.

It is certified that error appears in the above-identified patent and that said Letters Patent is hereby corrected as shown below:

```
DEL FEED
DEF FEED
2DRIVE1
3DRIVE1
1OUT.9-0
1OUT.10-1
2MA00
FOLEN00000
MC00000
0%COMEXC0
5%COMEXC1
6%COMEXC0
2MA00
1OUT.9-1
5%SPIN
T.5          ;T.1
1OUT.10-0
T.5          ;T.1
2A1.00000
2V0.25000 ;0.15000
;2D-50000  ;-127000
;2G01
1OUT.10-1
```

UNITED STATES PATENT AND TRADEMARK OFFICE

CERTIFICATE OF CORRECTION

PATENT NO. : 6,991,518 B1
APPLICATION NO. : 10/411300
DATED : January 31, 2006
INVENTOR(S) : Robert C. Gleason et al.

It is certified that error appears in the above-identified patent and that said Letters Patent is hereby corrected as shown below:

```
T.5          ;T.1
1OUT.9-0
T.5
2V.75
;2D50000    ;127000
;2GO1
folen000
;was 130000
2ma0
;2D100000
;2GO1
2tas
WAIT(2AS.1=B0)
;wait(2pe=0)
2tas
2tpe
folen011
2PSET0,0
FOLMAS,-44,-44
FOLENX11
COMEXC1
PRUN CAM1
;PRUN CAM2
4DRIVE1
4A1.00000
4V0.15
4D(VAR1)
4MC0
4GO1
WAIT(4AS.1=B0)
5%5A20
5%5V(VAR2)
5%5GO1
WAIT(4AS.1=B0)
WAIT(%5AS.4=B0)
1OUT.13-1
1OUT.11-1
6%TRIM
END
```

UNITED STATES PATENT AND TRADEMARK OFFICE

CERTIFICATE OF CORRECTION

PATENT NO. : 6,991,518 B1
APPLICATION NO. : 10/411300
DATED : January 31, 2006
INVENTOR(S) : Robert C. Gleason et al.

It is certified that error appears in the above-identified patent and that said Letters Patent is hereby corrected as shown below:

```
DEL TRIM
DEF TRIM
1MC0
1FOLEN0
1MA1
;go to 0, adjust by Size Adj Val
1D(VAR3)
1V.01
1G01
;reset Centerline to 0
1PSET0
;RESET ADJUSTMENT
VAR3=0
;Now cut wire off
1D-0.003
1G01
1D0
1G01
WAIT(1AS.1=B0)
WRITE"~DONE"
END

DEL MAIN
```

UNITED STATES PATENT AND TRADEMARK OFFICE

CERTIFICATE OF CORRECTION

PATENT NO. : 6,991,518 B1
APPLICATION NO. : 10/411300
DATED : January 31, 2006
INVENTOR(S) : Robert C. Gleason et al.

It is certified that error appears in the above-identified patent and that said Letters Patent is hereby corrected as shown below:

```
DEF MAIN
PSET0,,,0
COMEXC1
PRUN PROFILE
END

DEL TRST
DEF TRST
DRIVE1111
COMEXC0
;COPN
FOLEN00000
1V.1
2V.5
3V.5
VAR5=2PE*-1
VAR6=3PE*-1
1out.10-1
T.5
1out.9-0
T.5
2D(VAR5)
2go1
1out.9-1
T.5
1out.10-0
T.5
3D(VAR6)
3go1
1FOLEN0
1MC0
;absolute
1MA1
;move to surface of the wire less 10 thou
VAR7=VAR10+0.010
1D(VAR7)
1G01
;1MA0
WRITE"~DONE"
END
```

UNITED STATES PATENT AND TRADEMARK OFFICE

CERTIFICATE OF CORRECTION

PATENT NO. : 6,991,518 B1
APPLICATION NO. : 10/411300
DATED : January 31, 2006
INVENTOR(S) : Robert C. Gleason et al.

It is certified that error appears in the above-identified patent and that said Letters Patent is hereby corrected as shown below:

```
;active
DEL CAM1
DEF CAM1
2GOWHEN(3PE<=-70560)
PLOOP,0,0
FOLRN,1,1
FOLRD,1,1
FOLMD,14212,14212
D,-14112,-14112
FOLRNF,1,1
GOBUFX11
1poutb.9-0
1POUTB.9-1
1poutc.10-0
1POUTC.10-1
FOLRN,1,1
FOLRD,1,1
FOLMD,98784,98784
D,-98784,-98784
FOLRNF,1,1
GOBUFX11
1poutb.9-1
1POUTB.9-0
1poutc.10-1
1POUTC.10-0
FOLRN,1,1
FOLRD,1,1
FOLMD,14212,14212
D,-14112,-14112
```

UNITED STATES PATENT AND TRADEMARK OFFICE

CERTIFICATE OF CORRECTION

PATENT NO. : 6,991,518 B1
APPLICATION NO. : 10/411300
DATED : January 31, 2006
INVENTOR(S) : Robert C. Gleason et al.

It is certified that error appears in the above-identified patent and that said Letters Patent is hereby corrected as shown below:

```
FOLRNF,0,0
GOBUFX11
FOLRN,10,10
FOLRD,1,1
FOLMD,14112,14112
D,127008,127008
FOLRNF,0,0
GOBUFX11
PLN,11
END

STARTP SETUP
```

Signed and Sealed this

Fourteenth Day of November, 2006

JON W. DUDAS
*Director of the United States Patent and Trademark Office*